United States Patent [19]

Kazimer

[11] Patent Number: 4,462,294

[45] Date of Patent: Jul. 31, 1984

[54] CONTROL UNIT FOR AN ELECTRICAL MUSICAL INSTRUMENT

[76] Inventor: Ted Kazimer, Box 3, Site 10, R.R. #1, Hixon B.C. V0K 1S0, Canada

[21] Appl. No.: 433,151

[22] Filed: Oct. 6, 1982

Related U.S. Application Data

[63] Continuation-in-part of Ser. No. 210,946, Nov. 28, 1980, abandoned.

[51] Int. Cl.[3] ..... G10H 1/00

[52] U.S. Cl. ..... 84/1.01; 84/DIG. 22; 84/1.03

[58] Field of Search ..... 84/DIG. 22, 1.01, 1.03, 84/DIG. 7, 1.24

[56] References Cited

U.S. PATENT DOCUMENTS 4,276,801 7/1981 Yerusavage ..... 84/1.01

*Primary Examiner*—Forester W. Isen

*Attorney, Agent, or Firm*—Stanley E. Johnson; Richard J. Hicks

[57] ABSTRACT

Manually operable control apparatus for an electrical musical instrument such as an electronic organ having automatic chord circuitry which includes a plurality of spaced apart individually operable chord switches less in number than the number of chords available on the organ and connected to the chord circuitry of the organ through a multi-position gang selector switch arranged for a preselected different combination of chords at each of the different positions thereof. The chord switches permit individually activating any one of the individual chords in each of the preselected combination for each of the different positions of the gang selector switch.

15 Claims, 8 Drawing Figures

Fig. 1.
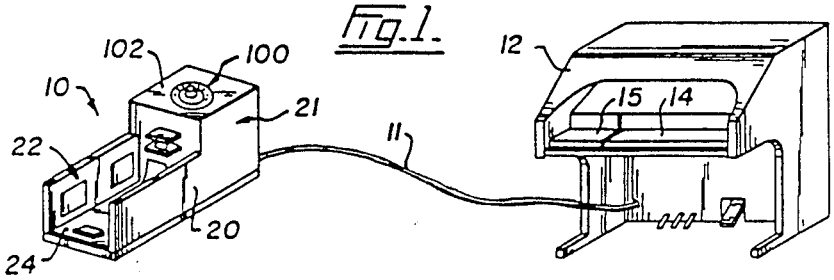
Fig. 2.
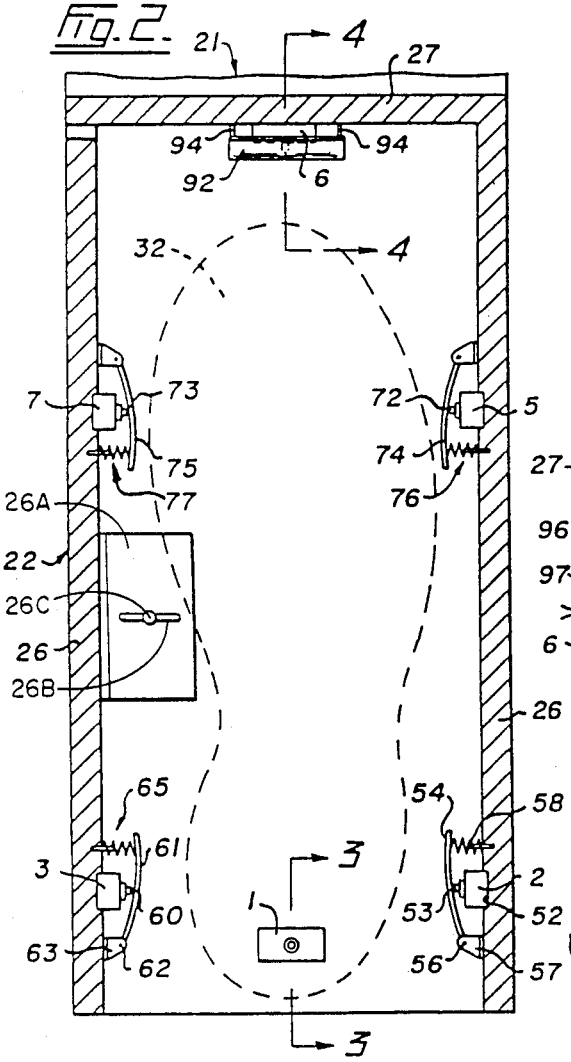
Fig. 4.
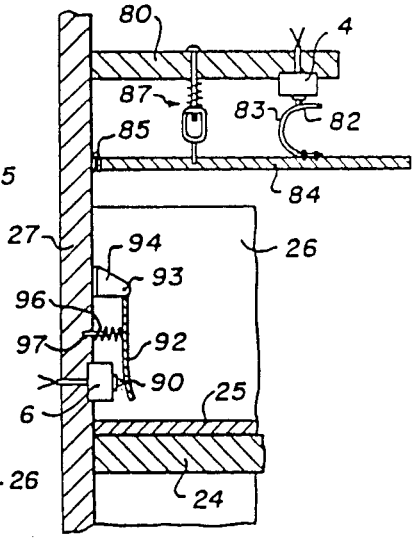
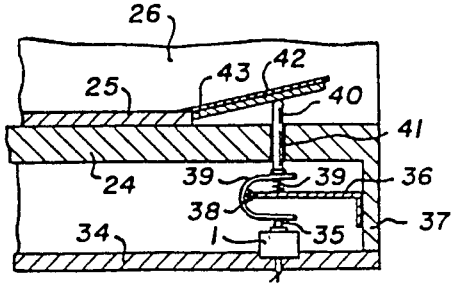
Fig. 3.

CONTROL UNIT FOR AN ELECTRICAL MUSICAL INSTRUMENT

CROSS-REFERENCE TO RELATED APPLICATION

This is a continuation-in-part of my co-pending U.S. application Ser. No. 210,946 filed Nov. 28, 1980, now abandoned.

FIELD OF INVENTION

This invention relates to a device for controlling chord generating devices and more particularly for playing different preselected chord combinations of the chord section of an organ which has automatic chording circuitry.

BACKGROUND OF INVENTION

Many musicians when playing solo before an audience are aware of moments when their particular instruments, no matter how well played, fail to produce the fullness and variety of sounds needed during a performance. As a result, it has become popular for a solo musician to accompany himself by using a rhythm box or other chord generating device. An electronic organ is particularly well suited to provide the required accompaniment but the rather complex keyboard and pedal system of such an instrument normally demands the full attention of another musician and hitherto it has not been possible for a solo musician playing his own instrument to make use of even the chords of an organ. Consequently, there is need for a relatively simple and easily operated control unit which will serve such a purpose.

DESCRIPTION OF THE PRIOR ART

A number of United States patents are known to have been granted for this general category of invention and these include U.S. Pat. No. 3,420,940 to Glass et al which relates to an automatic player for a musical instrument such as an organ. U.S. Pat. No. 2,761,344 to Koehl shows the combination of a piano and an electrical tone generating and translating system. U.S. Pat. No. 3,839,592 to Freeman relates to a system for automatically playing bass notes from accompaniment chords and also for playing the bass notes with sustain by operating pedals. U.S. Pat. No. 3,178,501 to Evans relates to a foot control which operates to vary the magnitude of low frequency signals fed from an electrical guitar to an amplifier unit. U.S. Pat. No. 3,193,608 to Bobis relates to a device intended to improve the rhythm patterns of an organ by using prerecorded tapes. U.S. Pat. No. 3,084,584 to Iorio discloses a combination musical instruments controlled in part by a pair of foot-operated volume controls.

None of the prior art references disclose devices for controlling the automatic chording section of an electric organ as is contemplated by the present invention.

SUMMARY OF THE INVENTION

The present invention provides means for playing any one of a preselected combination of different chords of an electric organ and, for this purpose, it comprises a support housing a number of spaced apart and suitably arranged chord switches which can be opened and closed by the musician, for example, by movement of the musician's foot. The chord switches are less in number than the chords available in the chord section of the organ (for example 3 to 7) and these switches are connected to a selector switch consisting of a plurality of switches ganged together for simultaneous operation whereby a preselected combination of different chords are individually playable by setting the selector switch and operating the chord switches.

The device preferably is a remote control unit wherein the support is appropriately shaped to accommodate one foot of a musician and the plurality of chord switches are arranged therein in spaced apart relation to be individually operated by appropriate movement of the musician's foot.

BRIEF DESCRIPTION OF THE DRAWINGS

In the drawings which illustrate a preferred embodiment of the invention:

FIG. 1 is a perspective view showing the present remote control unit connected to an electronic organ;

FIG. 2 is an enlarged horizontal section of a front portion of the unit;

FIG. 3 is a vertical section taken on the line 3—3 of FIG. 2;

FIG. 4 is another vertical section taken on the line 4—4 of FIG. 2;

DESCRIPTION OF THE PREFERRED EMBODIMENT

Figure 5:
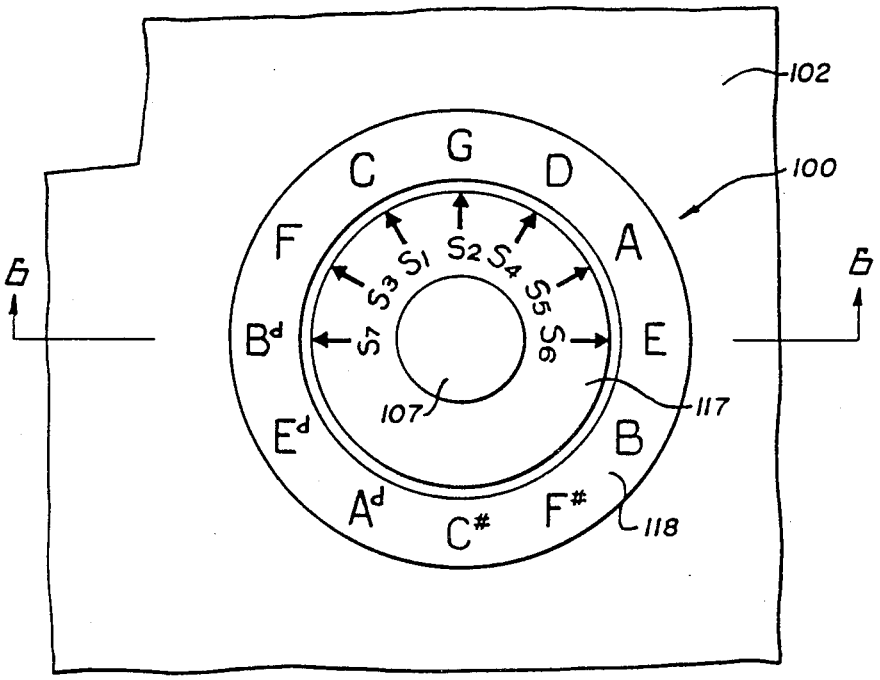
FIG. 5 is an enlarged plan view of a rear portion of the unit showing a selector switch thereof.

Referring to the drawings, the numeral 10 indicates generally a remote control unit provided in accordance with the present invention. FIG. 1 shows the unit 10 connected by a flexible conductor 11 to an electronic organ 12. This particular chord organ has the usual keyboard 14 which includes a chord section 15 on the left. The keys and the like forming the chord section normally allow an organist to play the automatic chords which are provided and on the type of organ to which the present invention is directed, only one switch need be keyed to create the complete chord. The present device is a foot-operated remote control unit which allows a solo guitar player, for example, who may be standing or sitting some distance from the organ, to play his own instrument and to accompany himself operating the electronic organ at least to the extent of playing the automatic chords available.

The remote control unit 10 desirably provides the equivalent of a number of chord keys or pedals and, for that purpose, the unit is constructed as a box-like support 20 which has a closed-in rear portion 21 and an open-topped front portion 22. The front portion 22 has a bottom wall 24 covered by a suitable padding 25, side walls 26, and an intermediate wall 27. The several walls of the front portion 22 provide an enclosure which will accommodate one foot of the solo guitar player and leave room for a sufficient amount of both lateral and back and forth foot movement. Desirably, at least one of the side walls 26 would be adjustably mounted to vary the spacing between the walls, thus providing a reasonable fit for a number of shoe sizes. In FIG. 2, one side wall 26 is shown detached from the intermediate wall 27 and attached to bottom wall 24 by an angle bracket 26A by way of a slot 26B therein and a screw 26C.

Mounted on the walls of the support 20 are switches designated 1 to 7. These switches are adapted to be connected into the electric circuitry of the organ so that the chords of the organ can be played by closing the switches. The arrangement of the normally open switches 1 to 7 can be seen in FIG. 2 in which the dotted line 32 represents the outline of the musician's foot. Switch 1 is located on the bottom wall 24 in a position where it is normally covered by the heel. Switches 2 and 3 are mounted on the opposing side walls 26, a suitable distance above the bottom wall, and slightly to the rear of switch 1. Switches 5 and 7 are also mounted one on each of the opposing side walls 26, again a suitable distance above the bottom wall 24, and in positions normally spaced from the sides of the foot a short distance to the rear of the toes. Switch 4 is mounted on the intermediate wall 27 well above the bottom wall and in a centrally-disposed position which spaces the switch clear of the toes when the sole is resting on the padding 25 and switch 1 is covered by the heel. Switch 6 is mounted on the intermediate wall 27 a short distance below switch 4 and also in a position to be clear of the toes when switch 1 is covered by the heel.

As shown best in FIG. 3, switch 1 preferably is carried by a bottom panel 34 provided on the support below the bottom wall 24. This switch has a contact-actuating plunger 35. A bracket 36 extends inwardly from a front edge strip 37 of the support and secured to an end of this bracket by a hinge 38 is a C-spring 39. Above the spring 39, another plunger 40 is slidably mounted in an opening 41 formed in the wall 24. The plunger is adapted to be depressed by actuation of a pedal 42 one end of which is secured to the wall 24 by means of a hinge 43. Thus, switch 1 is operably by the heel of the musician and, due to the particular construction of the switch, the operation can be effected without damage to the switch.

The normally open switch 2 may be inserted into a recess 52 (FIG. 2 only) on the right side wall 26 of the support so that its operating plunger 53 is horizontal. A substantially rectangular pedal 54 covers the plunger 53 and one edge of this pedal is secured by a vertical hinge 56 to a bracket 57 carried by the side wall 26. The musician closes switch 2 by swinging his heel to the right and into contact with the pedal 54 whereby to depress the plunger 53. A stop pin is mounted on the wall 22 and this pin supports a compression spring 58 which engages the pedal 54, these two elements combining to protect the switch from damage.

In FIG. 2, the switch 3 will be seen to be similarly carried on the left side wall 26 opposite switch 2. A plunger 60 of switch 3 is covered by a pedal 61 which is connected by a hinge 62 to a bracket 63 projecting inwardly from the side wall. Another stop pin and compression spring arrangement generally indicated at 65 protects the switch 3. This particular switch is closed by movement of the musician's heel towards the left side wall of the support 20. FIG. 2 also shows that the switches 5 and 7 are similarly mounted on the walls 26 so that their respective operating plungers 72 and 73 are transversely aligned. Hingedly mounted pedals 74 and 75 respectively engage the plunger 72 and 73, these two pedals preferably projecting towards the front of the support. Stop pin and spring arrangements generally indicated at 76 and 77 respectively are provided for the protection of switches 5 and 7. By moving the front of his foot from side to side, the musician is able to actuate the switches 5 and 7.

FIG. 4 shows that switch 4 is mounted on a bracket 80 projecting forwardly from the wall 27. This switch has a contactacting plunger 82 engaged by a C-spring 83 which is secured to an arm 84. A hinge 85 secures an end of the arm 84 to the intermediate wall 27. The arm 84 and the bracket 80 are interconnected by a suitable device generally indicated at 87, which device can be extended and retracted to adjust the operating pressure between the spring 83 and the plunger 82. It will be apparent that switch 4 is intended to be operated by appropriate vertical movement of the toe of the musician's foot when the heel is clear of switch 1.

In FIG. 4, the switch 6 is shown to have a horizontally disposed plunger 90 which is engaged by a pedal 92. The upper edge of this pedal is secured by a transverse hinge 93 to a bracket 94 mounted on the wall 27. Between the bracket and the switch 6, a small compression spring 96 is mounted on a stop pin 97 projecting from the wall whereby to cushion the plunger-operating movement of the pedal 92. Thus, the musician can operate switch 6 by moving his foot forward into contact with the pedal 92 whereby to depress the plunger 90.

The switches 1 to 7 are adapted to perform the same functions as some of the chord keys or pedals on the organ 12. An electronic organ of this type normally has 12 playable chords and, of course, there are only 7 chord switches provided on this particular embodiment of the remote control unit 10. In order that the musician using the present unit may select which chords will be playable, the unit is fitted with a suitable selector switch generally indicated at 100. This selector switch may have a printed circuit board provided with the usual slide control but a simple mechanical switch is preferred.

Figure 6:
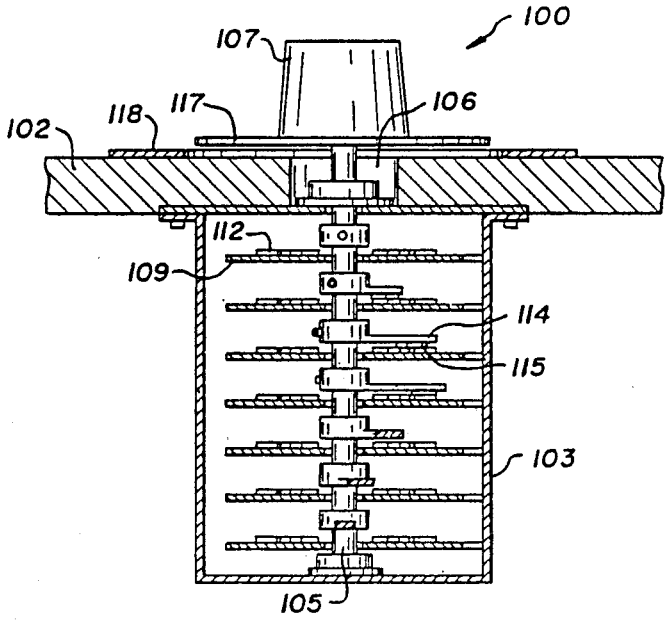
FIG. 6 is a vertical section taken on the line 6—6 of FIG. 7.

As shown in FIG. 1 and in details FIGS. 5 and 6, the selector switch 100 is mounted on a top wall 102 of the rear portion 21 so as to be mainly enclosed within that portion of the support. FIG. 6 shows the switch 100 as having a housing 103 which may be secured to the inner surface of the wall 102. A vertical shaft 105 is journalled in the housing and an upper end of this shaft projects through a wall opening 106 to receive a knob 107. The housing carries an annular plate 109 for each chord switch, the horizontal plates being vertically spaced apart along the shaft and the shaft being free to rotate within the annular plates. Each plate 109 has 12 circumferentially arranged contacts 112. An arm 114 is secured to the shaft adjacent each plate and this arm has a contact 115 adapted to engage the contacts 112 one at a time as the shaft is rotated by means of the knob. The selector switch 100 is of conventional design and therefore the internal switching arrangement and electrical connections thereto will not be described in greater detail although the circuit in which the selector switch is included will be dealt with later.

Referring now particularly to FIG. 5, the knob 107 will be seen to be fitted with a circular flange 117. On this flange there are circumferentially arranged index arrows which are designated S1, S2, etc. to correspond to the chord switches 1 to 7. An annular band 118 is secured to the outer surface of the top wall 102 to surround the knob 107 and this band is clearly marked with the 12 chords which normally are playable by the electric organ 12.

Figure 7:
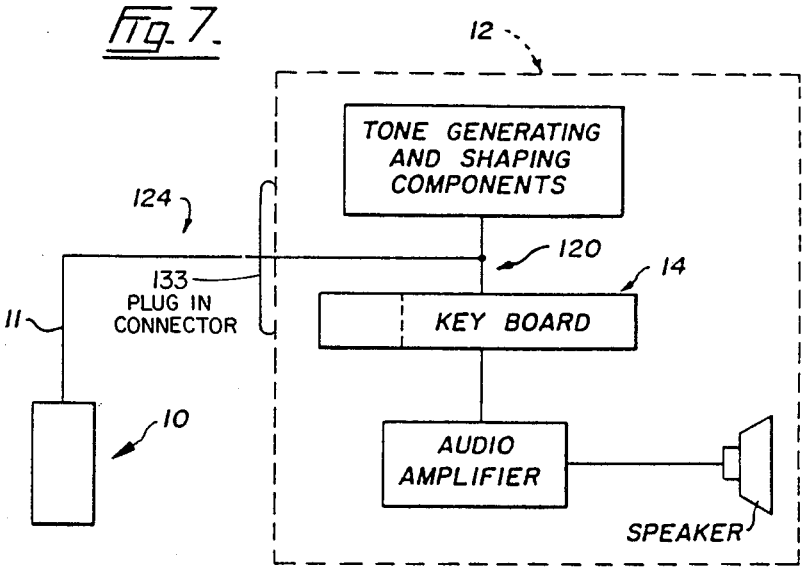
FIG. 7 is a block diagram showing the unit connected to the components of an electronic organ; and, FIG. 8 is a wiring diagram of the electric circuits of the remote control unit.

In FIG. 7, the electronic organ 12 is illustrated as a simplified block diagram and the keyboard 14 is shown connected to the tone generating and shaping components of the organ by a circuit which will herein be referred to as an automatic chord circuit 120. It is this circuit which is joined in a suitable manner by the flexible conductor 11 of the control unit 10 and that conductor forms part of a circuit means generally indicated at 124 for the remote control unit 10.

Figure 8:
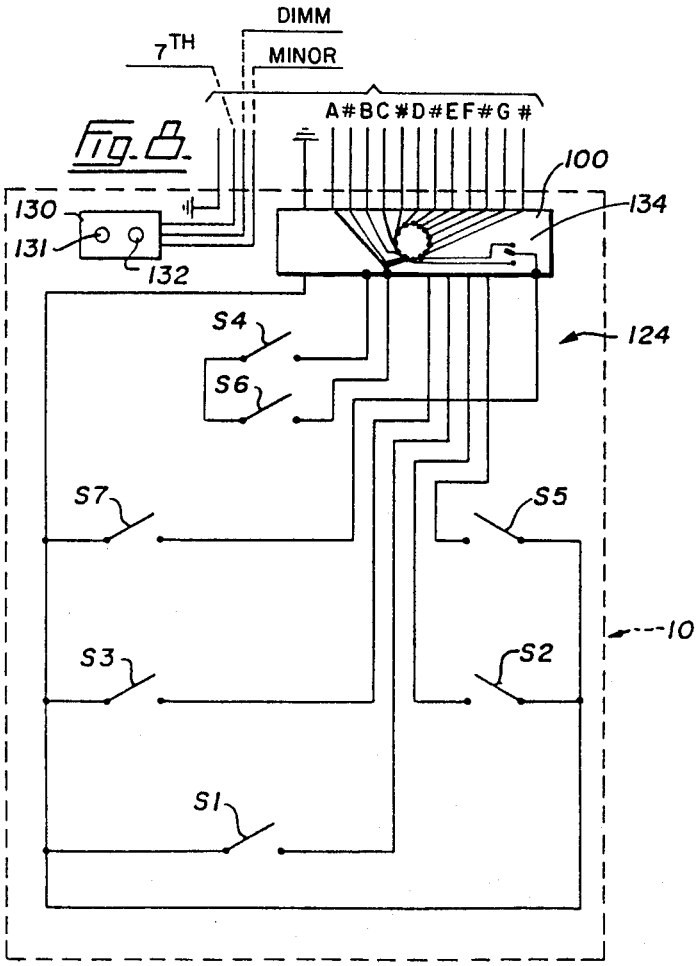

The circuit means 124 of the unit is shown in greater detail in FIG. 8 wherein the conductor 11 will be seen to comprise 15 wires. The left wire of the group leading to the selector switch 100 is a common ground wire which extends to each of the switches 1 to 7. Each of the other 12 wires to the right of the ground wire correspond to a particular chord on the organ and in the drawing are designated, from left to right A, ♯, B, C, ♯, D, ♯, E, F, ♯, G, ♯. Chord switch 1 is the primary switch in the unit and the remaining chord switches 2 to 7 are all sequentially related to this primary switch as will soon be described.

FIG. 8 also shows three wires to the left of the ground wire. These three wires lead to a switch 130 (FIG. 8 only) which may also be mounted on the support 20 in some convenient location where it is operable by the musician. Switch 130 has push buttons 131 and 132, the latter having two operating positions. A switch of this type enables diminished, seventh and minor chords of the organ 12 to be played from the unit 10. Normally, such chords are played by the pedals which are shown in front of the organ in FIG. 1 but the present unit allows this to be done by pushing button 131 to play the seventh chord and by operating the two position button 132 to play either the minor or diminished chords.

The guitar player or other musician who may want to provide chordal accompaniment for his solo number prepares for the performance by switching on the electric organ 12 and plugging in the remote control unit 10 to connect the circuit means 124 to the automatic chord circuit 120. The player than positions himself before the remote control unit 10 and considers the number he is about to play. There are, of course, 12 chords available to him on the organ but an experienced musician knows that usually only up to six chords are required for a particular number. Now the player selects the particular series of chords he wants to play and does so using the selector switch 100. Assuming that chord C is selected to be played by switch 1, the knob 107 on the selector switch is turned to the position shown in FIG. 5 where S1 is in register with chord C. A glance at the face of the selector switch then tells the musician that switch 2 will play chord G, switch 3 will play chord F, switch 4 will play chord D, switch 5 will play chord A, switch 6 will play chord E, and switch 7 will automatically play chord B flat or any other chord which may be preselected to accommodate any incidental chords which may not be included in the normal scale of fifths. In order to select any chord to be played by switch 7 a selector switch 134 is provided where in one position the scale of fifths is applicable and in the other position any individual chord may be played by switch 7 by appropriately positioning the gang switch. The preselection of chords is determined by the way the seven plates 109 and their associated contacts are wired up in the selector switch 100. This particular chord sequence has been chosen as the one best suited for the switch arrangement in the remote control unit. The additional selector switch 134 gives the musician the option of using switch 7 for any chord or alternatively it may be left in the normal sequence of the scale of fifths position, which of course will be B flat in the key of C on the primary switch.

The musician can now play his solo number and operate the unmanned organ at least to the extent that seven of the chords are playable. With his foot properly positioned in the unit as shown in FIG. 1, the musician closes or opens switch 1 to play chord C when required and does so by raising or lowering his heel. Chords G and F are played by moving the heel portion of the foot from side to side whereby to close switches 2 and 3. Chords A and B flat are played when switches 5 and 7 are closed by sideways movement of the foot near the toe. If the chords D and E are to be played, the musician operates their switches 4 and 6 by lifting his toe up in the case of switch 4 or moving it forward in the case of switch 6.

Assuming now that the next number calls for another sequence of chords not more than seven in number, and that the musician decides to "key" chord G to primary switch 1, he does so by turning the selector switch 100 to place S1 in register with chord G. Automatically the remaining chord switches 2 to 7 are connected by the selector switch to play their respective chords D, C, A, E, B and F. It follows that, when the knob 107 is turned to place S1 appearing on the flange 107 in register with chord D on the band 118, then chord D is played by closing the primary switch 1 and the remaining switches 2 to 7 will play chords A, G, E, B, F sharp and C respectively.

Control unit 10 described in the foregoing will allow the musician to select a desired seven chord sequence to play by means of the chord switches. An accomplished musician may use all seven chords as an accompaniment and less accomplished musicians may use fewer chords. Some, for example, may use only three chords as an accompaniment and in which case the control unit may be manufactured utilizing only three chord control switches in association with the simpler selection switch. The control unit 10 is preferably a remote control unit, but if desired, can obviously be incorporated in an electrical musical instrument, for example, an organ having automatic chording circuitry incorporated therein. There are less chord switches than chords available on the organ but the unit 10 permits the selection of the chords which are to be played in a predetermined sequence according to the arrangement of the switches in the unit.

The prearrangement of the chords is based on the scale of fifths and are predetermined on one selector switch allowing an automatic selection of chords regardless of positions of switches around the foot which remain the same. There are no pedals to confuse the operator and as any musician well knows, the basic two chord structure is a scale of fifths. The selector switch is wired based on the scale of fifths and the operator does not have to have knowledge of the same as it is automatically achieved in all keys by simply dialing the basic key on the selector switch and the switch does the rest. Thus, a relatively novice musician can achieve, with the present device, substantially the same success as a pro without years of musical study. The switches 1 to 7 and the arrangement on the selector switch is such that the relative minor chord to any key is activated by the same switch, for example, switch 5 regardless of key and the off-chord is most always switch 4. Any musician can thus readily see and play even the relatively difficult tunes by learning the simple arrangement of the chord switches regardless in what key the musician may be playing. Although the basid melody of a tune must be the same in all performances the performer may not be able to sing or play in the key for which the musical score has been written and usually chooses a key more suited to his particular voice or ease of playing a tune. The musician by simply selecting and trying in each key can quickly find the easiest key most suited, up or down in sound, and the chords are automatically preselected at the same position relative to foot movement and are so indicated on the selector switch. The musician thus automatically knows which chords to play on the other instrument, i.e., the hand-held instrument.

The gang selector switch requires the musician only a second to select and then play and thus can quickly and easily switch from one number to another, taking little time between numbers which can be annoying to the audience if the musician is to individually set a number of different switches.

Switch 100 is a multi-position gang switch, i.e., a plurality of switches ganged together for simultaneous operation. While the switch illustrated is a rotary, mechanical-type switch, other arrangements obviously may be used to accomplish the same result, for example, a sliding switch or an arrangement of electronically intercoupled switches.

In the foregoing and as illustrated in FIG. 1, organ 12 is a complete musical instrument. It is contemplated, however, that a separate, readily portable box-like unit may be provided incorporating therein only the chord section of the organ and automatic circuitry associated therewith and as previously indicated is the type of organ where only one switch need be keyed to create the complete chord as opposed to three switches required in some of the older electronic organs.

The embodiments of the invention in which an exclusive property or privilege is claimed are defined as follows:

1. An apparatus for selectively playing the chord section of an electrical musical instrument, for example, an electronic organ, having automatic chord circuitry with "n" number of chords comprising:

(a) a plurality of manually-operable individual chord switches mounted on suitable mounting means in selected spaced apart relation relative to one another around a defined area;

(b) a multi-position selector switch means switchable from one to another of a plurality of different positions and comprising a plurality of switches ganged together to operate in unison and connected to the chord circuitry so as to provide a different preselected combination of chords less than "n" at the respective different positions of the selector switch, said individual chord switches being operatively connected through the selector switch so as to permit individually activating each of the respective ones of the different chords in the preselected combination at each of the different positions of the multi-position selector switch; and, (c) means connecting said multi-position selector switch to the automatic chord circuitry of the electrical musical instrument.

2. The apparatus of claim 1, wherein said chord switches are mounted in a support separate from the musical instrument for use at a location remote therefrom.

3. The apparatus of claim 1, wherein said chord and selector switch are mounted on said musical instrument.

4. The apparatus of claim 2, wherein the remote control unit is foot-operable and includes a primary chord switch operable by the heel of the musician's foot, the remaining chord switches being connected by the selector switch to individual chords of the chord selector and positioned in a predetermined location relative to one another and the primary chord switch irrespective of the key selected for the primary chord switch.

5. The apparatus of claim 4, wherein two of said plurality of chord switches are mounted in a position for operation by respective opposite sides of the heel portion of the musician's foot.

6. The apparatus of claim 5, wherein another two of said plurality of chord switches are mounted in a position for operation by respective opposite sides of the musician's foot adjacent the toe portion.

7. The apparatus of claim 6, wherein still another two of said plurality of chord switches are mounted for operation by forward and upward movement of the toe of the musician's foot.

8. The apparatus of claim 2, wherein said selector switch includes means visually indicating the preselected combination of chords at each of the different positions thereof and operable by designated different ones of the chord switches.

9. Apparatus for use in playing the chord section of an electrical musical instrument such as an electronic organ having automatic chord circuitry, said apparatus comprising a foot support unit having a plurality of individually operable chord switches mounted thereon in spaced apart relation relative to one another around a selected area so as to be operable by limited horizontal and vertical movement of the musician's foot, said chord switches being fewer in number than the chords available in the chord section, a multiposition selector switch comprising a plurality of switches ganged together to operate in unison and operatively connecting the chord switches to the chord section in a different preselected combination of chords at each of the different positions thereof whereby the preselected combination of chords are individually playable by actuation of the chord switches for each of the different positions of the selector switch.

10. The apparatus of claim 9, wherein said selector switch is mounted on said foot support unit.

11. The apparatus of claim 9, wherein there are in the range of three to seven chord switches mounted on said foot support unit.

12. The apparatus of claim 9, wherein said foot support unit has spaced apart side walls thereon limiting lateral movement of the musician's foot, wherein at least one of said side walls is adjustably movable toward and away from the other to accommodate different foot sizes and wherein some of said chord switches are mounted on said side walls.

13. An apparatus for selectively playing the chord section of an electrical musical instrument, for example, an electronic organ, having automatic chord circuitry with "n" number of chords comprising:

(a) a plurality of individually, manually-operable chord switches mounted on suitable mounting means in spaced apart relation relative to one another on said mounting means around a selected area; and, (b) a multi-position selector switch means switchable from one to another of a plurality of positions and comprising a plurality of switches ganged to operate in unison and arranged so as to provide a different preselected combination of chords less than "n" at the respective different positions, said individual chord switches being operatively connected through the selector switch to the automatic circuitry of the musical instrument so as to permit individually activating each of the respective ones of the different chords in the preselected combination at each of the different positions of the multi-position selector switch.

14. The apparatus of claim 13, wherein there are at least three chord switches.

15. The apparatus of claim 13, wherein "n" equals 12 with chords 1 to 12 being respectively C, G, D, A, E, B, F sharp, C sharp, A flat, E flat, B flat and F, and wherein the preselected combination of chords at each of the different positions comprises at least three adjacent ones of the foregoing designated chords.

* * * * *